US007084546B2

(12) United States Patent
Kageyama et al.

(10) Patent No.: US 7,084,546 B2
(45) Date of Patent: Aug. 1, 2006

(54) COMMUTATOR, MANUFACTURING METHOD OF COMMUTATOR, MANUFACTURING APPARATUS OF COMMUTATOR AND COMMUTATOR PLATE MATERIAL

(75) Inventors: Ryohei Kageyama, Hamamatsu (JP); Nobuo Kasao, Kosai (JP); Toshiyuki Ohsawa, Hamana-gun (JP)

(73) Assignee: ASMO Co., Ltd., Shizuoka-ken (JP)

( * ) Notice: Subject to any disclaimer, the term of this patent is extended or adjusted under 35 U.S.C. 154(b) by 210 days.

(21) Appl. No.: 10/673,339

(22) Filed: Sep. 30, 2003

(65) Prior Publication Data

US 2004/0066110 A1 Apr. 8, 2004

(30) Foreign Application Priority Data

Oct. 3, 2002 (JP) ..... 2002-291000

(51) Int. Cl.
*H01R 39/04* (2006.01)

(52) U.S. Cl. ..... 310/233; 310/234; 310/235; 310/51

(58) Field of Classification Search ..... 310/233–236, 310/51
See application file for complete search history.

(56) References Cited

U.S. PATENT DOCUMENTS

| | | | | |
|---|---|---|---|---|
| 3,376,443 | A * | 4/1968 | McColl | 310/235 |
| 3,492,519 | A * | 1/1970 | Boyer et al. | 310/235 |
| 5,003,212 | A * | 3/1991 | Ibe et al. | 310/235 |
| 6,489,703 | B1 * | 12/2002 | Terada et al. | 310/233 |
| 2001/0004177 | A1 * | 6/2001 | Terada et al. | 310/233 |

FOREIGN PATENT DOCUMENTS

| | | | |
|---|---|---|---|
| JP | 09168255 | A * | 6/1997 |
| JP | B2-3360509 | | 10/2002 |

* cited by examiner

*Primary Examiner*—Darren Schuberg
*Assistant Examiner*—Yahveh Comas
(74) *Attorney, Agent, or Firm*—Posz Law Group, PLC

(57) ABSTRACT

A commutator includes a generally cylindrical dielectric body and a plurality of commutator segments arranged along an outer peripheral surface of the dielectric body. Each commutator segment includes a ridge, which extends in a direction generally parallel to an axial direction of the commutator and radially inwardly projects into the dielectric body to secure the commutator segment relative to the dielectric body. Each ridge includes alternately arranged high projecting portions and low projecting portions. Each high projecting portion includes grooves, which are obliquely angled relative to the longitudinal direction of the ridge, and protrusions, each of which is bound with one of the grooves and protrudes in an imaginary plane generally perpendicular to the projecting direction of the ridge.

16 Claims, 11 Drawing Sheets

COMMUTATOR, MANUFACTURING METHOD OF COMMUTATOR, MANUFACTURING APPARATUS OF COMMUTATOR AND COMMUTATOR PLATE MATERIAL

CROSS REFERENCE TO RELATED APPLICATION

This application is based on and incorporates herein by reference Japanese Patent Application No. 2002-291000 filed on Oct. 3, 2002.

BACKGROUND OF THE INVENTION

1. Field of the Invention

The present invention relates to a commutator, a manufacturing method of the commutator, a manufacturing apparatus of the commutator and a commutator plate material.

2. Description of Related Art

A previously proposed commutator includes a generally cylindrical dielectric body and a plurality of commutator segments. The dielectric body is made of a resin material, and the commutator segments are arranged along an outer peripheral surface of the dielectric body in the circumferential direction of the dielectric body. Such a commutator is formed in the following manner. That is, a commutator plate material is rolled into a cylindrical shape. Then, a resin material in a liquid state is filled into an inner space of the cylindrically rolled plate material. After solidification of the resin material, the cylindrically rolled plate material is cut and is divided into a plurality of segments at generally equal angular intervals. Each divided segment forms the commutator segment, and the solidified resin material forms the dielectric body.

In the above commutator plate material, a plurality of ridges is formed in such a manner that the ridges extend parallel to one another in a direction that corresponds to the axial direction of the commutator, and the number of the ridges corresponds to the number of the commutator segments (e.g., one ridge per one commutator segment). A plurality of protrusions, which protrude in a direction perpendicular to a projecting direction of the ridge, is provided in each ridge. When the commutator plate material is rolled into the cylindrical shape, the ridges and the protrusions are arranged on the inner peripheral side of the commutator plate material and are engaged with the solidified resin material to prevent detachment of the respective commutator segments from the dielectric body upon cutting of the commutator plate material into the commutator segments.

Such a commutator is disclosed in, for example, Japanese Unexamined Patent Publication No. 2001-245456 that corresponds to U.S. Pat. No. 6,489,703, the contents of which are incorporated by reference.

However, in the above-described commutator, each ridge of the commutator segment extends continuously at a generally constant height (i.e., a generally constant projecting length) from one axial end of the commutator segment main body to the other axial end of the commutator segment main body. Thus, each ridge does not substantially engage with the dielectric body in the axial direction. Because of this, at the time of resistance welding between a commutator riser, which extends from one axial end of the commutator segment main body, and a corresponding coil, a relatively large force is radially inwardly applied from a fusing electrode to the one axial end of the corresponding commutator segment main body through the commutator riser. The application of the relatively large force can cause lifting of the other axial end of the commutator segment main body. This will form steps from one commutator segment to the next commutator segment and will prevent smooth sliding engagement between the commutator segments and power supply brushes upon rotation of the motor. As a result, mechanical vibrations, mechanical noises and electric noises are generated upon rotation of the motor.

SUMMARY OF THE INVENTION

The present invention addresses the above disadvantages. Thus, it is an objective of the present invention to provide a commutator that includes a plurality of commutator segments, each of which are more effectively held in a dielectric body. It is another objective of the present invention to provide a manufacturing method of such a commutator. It is a further objective of the present invention to provide a manufacturing apparatus for manufacturing such a commutator. It is a further objective of the present invention to provide a commutator plate material, from which the commutator segments of such a commutator, is formed.

To achieve the objectives of the present invention, there is provided a commutator, which includes a generally cylindrical dielectric body and a plurality of commutator segments arranged along an outer peripheral surface of the dielectric body. Each commutator segment includes at least one ridge, which extends in a direction generally parallel to an axial direction of the commutator and radially inwardly projects into the dielectric body to secure the commutator segment relative to the dielectric body. Each ridge includes a plurality of high projecting portions and a plurality of low projecting portions. Each high projecting portion has a projecting length, which is measured from a base end of the ridge in a projecting direction of the ridge and is longer than that of each low projecting portion. The high projecting portions and the low projecting portions of each ridge are alternately arranged in a longitudinal direction of the ridge. At least one of the high projecting portions of each ridge includes at least one groove and at least one protrusion. The at least one groove is obliquely angled relative to the longitudinal direction of the ridge. The at least one protrusion is bound with one of the at least one groove and protrudes in an imaginary plane generally perpendicular to the projecting direction of the ridge.

To achieve the objectives of the present invention, there is also provided a method for manufacturing a commutator. According to the method, a plate material that has a plurality of parallel ridges is provided. Then, each ridge of the plate material is intermittently pressed with at least one projecting portion forming punch along a length of the ridge to provide alternately arranged high projecting portions and low projecting portions along the length of the ridge. Next, at least one of the high projecting portions of each ridge is pressed with at least one groove forming punch to form at least one groove, which is obliquely angled relative to a longitudinal direction of the ridge, in each of the at least one of the high projecting portions in such a manner that formation of the at least one groove results in simultaneous formation of at least one protrusion in each of the at least one of the high projecting portions. Each protrusion of the at least one of the high projecting portions protrudes in an imaginary plane generally perpendicular to a projecting direction of the corresponding ridge. Thereafter, the plate material is rolled into a cylindrical shape such that the ridges are placed on an inner peripheral side of the cylindrically rolled plate material. Then, dielectric resin in a liquid phase is filled into a space defined radially inward of the cylindrically rolled plate material. Finally, the cylindrically rolled plate material is cut and is divided at predetermined angular intervals to form a plurality of commutator segments after solidification of the resin.

To achieve the objectives of the present invention, there is further provided an apparatus for manufacturing a commutator from a plate material, which includes a plurality of parallel ridges. The apparatus includes at least one projecting portion forming punch and at least one groove forming punch. The at least one projecting portion forming punch intermittently presses each ridge of the plate material along a length of the ridge to provide alternately arranged high projecting portions and low projecting portions along the length of the ridge. The at least one groove forming punch presses at least one of the high projecting portions of each ridge to form at least one groove, which is obliquely angled relative to a longitudinal direction of the ridge, in each of the at least one of the high projecting portions in such a manner that formation of the at least one groove results in simultaneous formation of at least one protrusion in each of the at least one of the high projecting portions. Each protrusion of the at least one of the high projecting portions protrudes in an imaginary plane generally perpendicular to a projecting direction of the corresponding ridge.

To achieve the objectives of the present invention, there is also provided a commutator plate material that includes a plurality of parallel ridges. Each ridge includes a plurality of high projecting portions and a plurality of low projecting portions. Each high projecting portion has a projecting length, which is measured from a base end of the ridge in a projecting direction of the ridge and is longer than that of each low projecting portion. The high projecting portions and the low projecting portions of each ridge are alternately arranged in a longitudinal direction of the ridge. At least one of the high projecting portions of each ridge includes at least one groove and at least one protrusion. The at least one groove is obliquely angled relative to the longitudinal direction of the ridge. The at least one protrusion is bound with one of the at least one groove and protrudes in an imaginary plane generally perpendicular to the projecting direction of the ridge.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

A first embodiment of the present invention will be described with reference to FIGS. 1 to 9.

Figure 1:
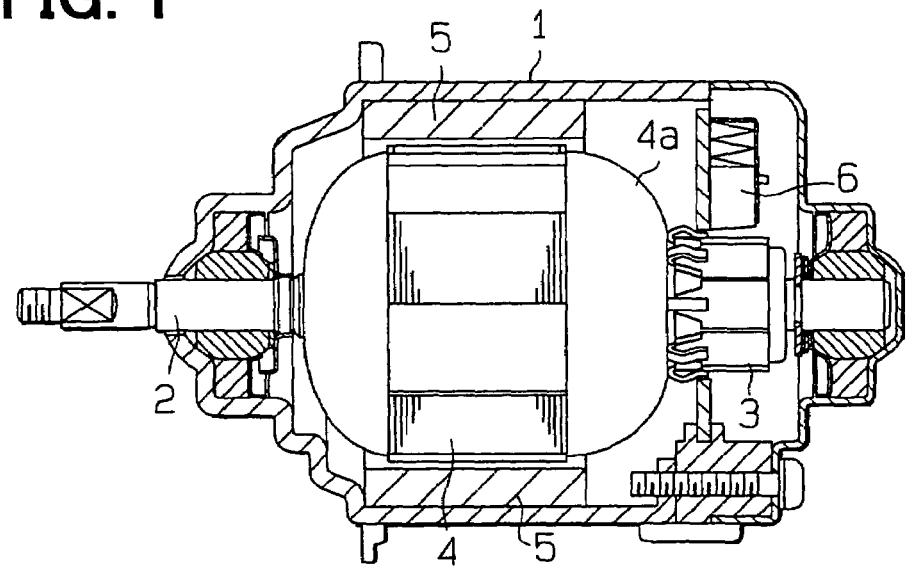
FIG. 1 is a schematic cross sectional view of a motor according to a first embodiment of the present invention.

FIG. 1 is a schematic cross sectional view of a motor according to the present embodiment. A rotatable shaft 2 is rotatably supported by a motor housing 1 of the motor. A commutator 3 and an armature core 4 having coils wound therearound are secured to the rotatable shaft 2. A plurality of magnets 5 are secured to an inner peripheral surface of the motor housing 1 in opposed relationship to the armature core 4. Furthermore, a plurality of power supply brushes 6, which are urged against the commutator 3, is supported by the motor housing 1.

Figure 2:
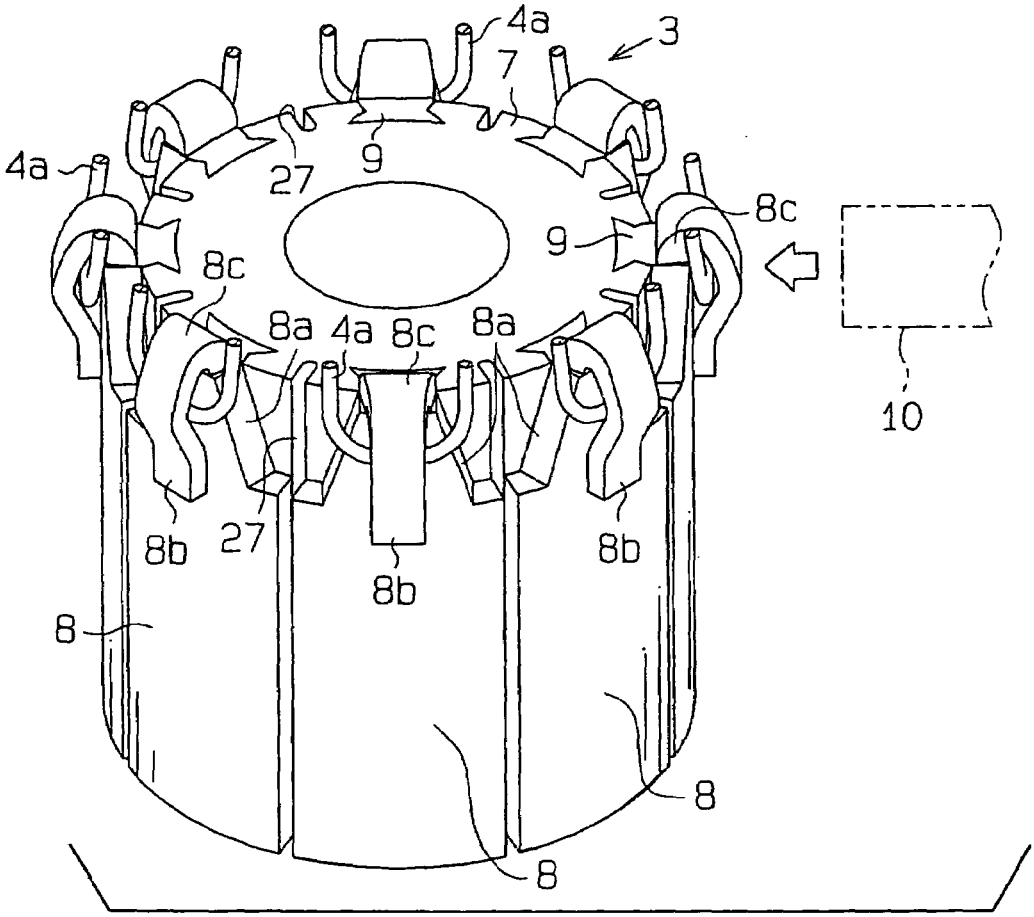
FIG. 2 is a perspective view of a commutator of the motor of the first embodiment.

As shown in FIG. 2, the commutator 3 includes a dielectric body 7 and a plurality of commutator segments 8. The dielectric body 7 is made of a dielectric resin material and is shaped into a generally cylindrical form. The commutator segments 8 are arranged around the dielectric body 7 at equal angular intervals in a circumferential direction of the dielectric body 7. In the present embodiment, the number of the commutator segments 8 is eight.

The commutator segments 8 are formed like segments of a generally cylindrical body, which are cut at predetermined angular intervals. A width reducing portion 8*a* is formed at one axial end of each commutator segment 8. A circumferential width of the width reducing portion 8*a* is reduced toward a distal end (top end in FIG. 2) of the commutator segment 8. A ridge 9 extends from a surface (hereinafter, this surface will be referred to as an inner peripheral surface) of each commutator segment 8, which is secured to the dielectric body 7. The ridge 9 of each commutator segment 8 projects into the dielectric body 7 in a thickness direction of the commutator segment 8 (i.e., in a radial direction of the commutator 3). A commutator riser 8*b* extends from a distal end of the width reducing portion 8*a* of each commutator segment 8 (more specifically, the distal end of the commutator segment main body of the commutator segment) and is bent radially outwardly. A cross section reducing portion 8*c* is formed in a base of the commutator riser 8*b*, and a cross sectional area of the reducing portion 8*c* is reduced toward a distal end of the reducing portion 8*c*. A corresponding coil 4*a* is engaged to the commutator riser 8*b*. Specifically, the coil 4*a* is placed around the commutator riser 8*b* and is then secured to the commutator riser 8*b* when a fusing electrode 10 is radially inwardly urged against the commutator riser 8*b* (also against one axial end of the commutator segment 8) and initiates resistant welding of the coil 4*a* to the commutator riser 8*b* and the width reducing portion 8*a* to electrically and mechanically connect the coil 4*a* to the commutator riser 8*b* and the width reducing portion 8*a*.

Figure 9:
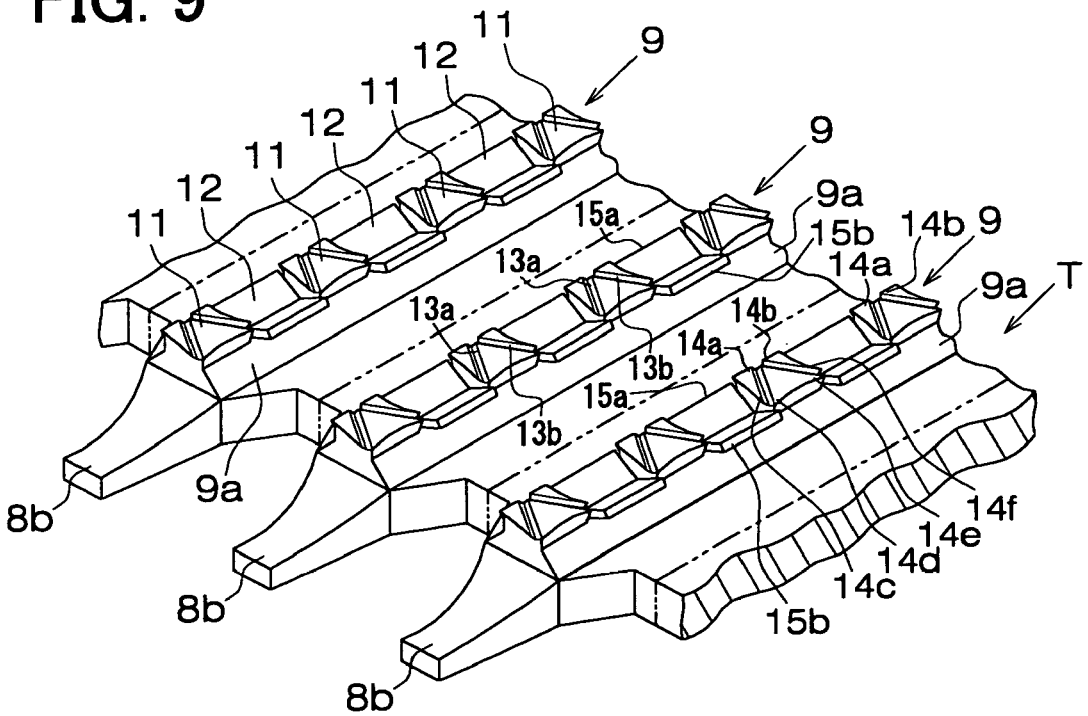
FIG. 9 is a partial perspective view of the commutator plate material of the first embodiment after removal of unneeded portions from the commutator plate material.

Each ridge 9 is formed in the circumferential center of the corresponding commutator segment 8. As shown in FIG. 9, each ridge 9 includes a plurality of high projecting portions 11 having a high degree of projection and a plurality of low projecting portions 12 having a low degree of projection. In comparison to the low projecting portion 12, the high projecting portion 11 has a higher degree of projection, i.e., a longer projecting length measured from a base end of the ridge 9 in the projecting direction of the ridge 9. Furthermore, the high projecting portions 11 and the low projecting portions 12 are alternately arranged in an axial direction of the dielectric body 7, i.e., in a longitudinal direction of the ridge 9. FIG. 9 shows a commutator plate material (or simply referred to as a plate material T), which is deformed into a cylindrical shape upon rolling of the plate material T in a manner that places the ridges 9 in the inner peripheral side of the cylindrically rolled plate material T. Furthermore, the commutator segments 8 are formed from the plate material T when the cylindrically rolled plate material T is cut and is divided at equal angular intervals (the intervals are shown by dot-dot dash lines in FIG. 9). Since the shape of the ridge 9 of each commutator segment 8 does not substantially change upon rolling of the plate material T into the cylindrical shape, the structure of the ridge 9 will be described with reference to FIG. 9.

In each ridge 9, a widening portion 9*a* is formed from the intermediate point toward the base end of each ridge 9 in the projecting direction of the ridge 9 (i.e., the projecting direction of the high projecting portion 11 or of the low projecting portion 12) and has an increasing width in the circumferential direction i.e., in the direction, which corresponds to the circumferential direction of the commutator 3 and of the dielectric body 7 and also corresponds to a transverse direction of the ridge 9. Here, it should be noted that the transverse direction of the ridge 9 refers to a direction, which is perpendicular to the longitudinal direction of the ridge 9 and is parallel to a plane of the plate material T (or a plane located between the ridges 9 in the plate material T shown, for example, in FIG. 3).

Two grooves 13*a*, 13*b* are formed in a projecting end surface (i.e., a top surface in FIG. 9) of each high projecting portion 11. Each groove 13*a*, 13*b* is angled with respect to longitudinal edges of the ridge 9, which extend parallel to the longitudinal direction of the ridge 9. Here, the longitudinal edges of the ridge 9 refer to longitudinal edges of an imaginary rectangular defined by a projecting end surface of the ridge 9 before formation of the grooves 13*a*, 13*b*. Furthermore, the longitudinal edges of the ridge 9 are parallel to the axial direction of the commutator 3 and of the dielectric body 7. Also, it should be noted that each groove 13*a*, 13*b* is angled at an oblique angle (i.e., an angle other than a right angle) with respective to the longitudinal edges of the ridge 9. In other words, each groove 13*a*, 13*b* is obliquely angled relative to the longitudinal direction of the ridge 9. Furthermore, for the sake of convenience, the term "ridge 9" is used to refer both the ridge 9 before formation of the grooves 13*a*, 13*b* and the ridge 9 after formation of the grooves 13*a*, 13*b*.

Each groove 13*a*, 13*b* is a V-shaped groove, which has a reducing width that is reduced toward a bottom of the groove, and extends linearly along its length. Also, each groove 13*a*, 13*b* extends from one lateral edge of the ridge 9 to the other lateral edge of the ridge 9 generally in the transverse direction of the ridge 9, i.e., in the circumferential direction of the dielectric body 7 in such a manner that the groove 13*a*, 13*b* divides the corresponding high projecting portion 11 into smaller segments. Furthermore, in the present embodiment, each groove 13*a*, 13*b* is angled at 60 degrees with respect to the longitudinal edges of the ridge 9. The groove 13*a* and the groove 13*b* are angled in opposite directions. In each ridge 9, the grooves 13*a* and the grooves 13*b* are alternately arranged in the longitudinal direction of the ridge 9 (i.e., the axial direction of the dielectric body 7). That is, the grooves 13*a* and the grooves 13*b* are arranged in a staggered formation. One groove 13*a* extends from one lateral edge (i.e., the top edge in FIG. 8) of the high projecting portion 11 to the low projecting portion 12 side edge (i.e., the left edge in FIG. 8) of the high projecting portion 11.

Figure 8:
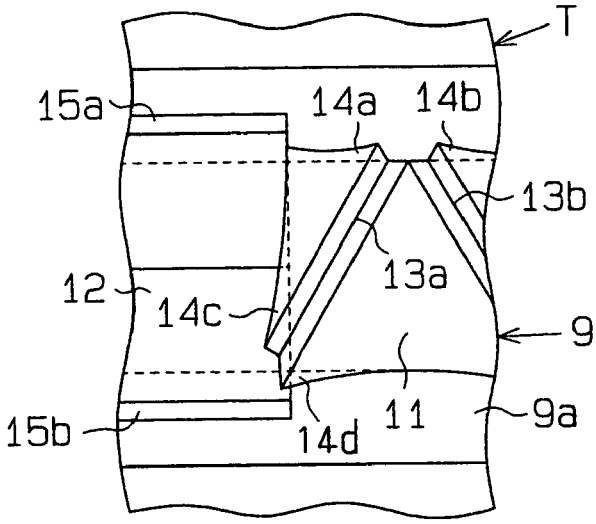
FIG. 8 is an enlarged partial plan view of the commutator plate material, showing the grooves and protrusions formed in one of the high projecting portions according to the first embodiment.

In each high projecting portion 11, protrusions 14*a*–14*f* (FIGS. 8 and 9) are formed at the time of forming the grooves 13*a*, 13*b*. The protrusions 14*a*–14*f* protrude in an imaginary plane generally perpendicular to the projecting direction of the ridge 9. More specifically, among the protrusions 14*a*–14*f*, each of the protrusions 14*a*, 14*b* and each of the protrusions 14*d*, 14*e* protrude in opposite directions, which are generally perpendicular to the projecting direction of the high projecting portion 11 and are parallel to the circumferential direction of the dielectric body 7. That is, each of the protrusions 14*a*, 14*b*, 14*d*, 14*e* projects in the corresponding direction, which is the corresponding circumferential direction of the commutator 3 and of the dielectric body 7 and is the corresponding transverse direction of the ridge 9. Furthermore, each of the protrusions 14*c*, 14*f* protrudes in the corresponding direction, which is generally perpendicular to the projecting direction of the high projecting portion 11 and is parallel to the axial direction of the commutator 3. In other words, each of the protrusions 14*c*, 14*f* protrudes in the longitudinal direction of the ridge 9 over an adjacent one of the lower projecting portions 12 of the ridge 9. FIG. 8 is a schematic plan view of a portion of the ridge 9 seen in the projecting direction of the ridge 9. In FIG. 8, dotted lines, which correspond to the protrusions 14*a*–14*d*, indicate base end lines of the protrusions 14*a*–14*d*. That is, the portions, which project from the dotted lines, correspond to the protrusions 14*a*–14*d*, respectively. Here, it should be noted that although the protrusions 14*e*, 14*f* are not illustrated in FIG. 8, the protrusion 14*e* projects in a manner similar to that of the protrusion 14*d*, and the protrusion 14*f* projects in a manner similar to that of the protrusion 14*c* but in the opposite direction.

The protrusions 14*a*–14*f* will be described more specifically. Acutely angled portions of each high projecting portion 11, which are separated by the grooves 13*a*, 13*b*, have relatively small volumes. Thus, at the time of forming the grooves 13*a*, 13*b*, the acutely angled portions of the high projecting portion 11 are displaced (or bent) and are projected in the direction perpendicular to the projecting direction of the high projecting portion 11 to form the protrusions 14*a*–14*f*. Each groove 13*a*, 13*b* extends from the one lateral edge of the high projecting portion 11 to the other lateral edge of the high projecting portion 11 and is angled relative to the lateral edges of the ridge 9 (or relative to the longitudinal axis of the ridge 9). Thus, each groove 13*a* (or 13*b*) can make the corresponding protrusions 14*a*, 14*c*, 14*d* (or 14*b*, 14*f*, 14*e*).

Each low projecting portion 12 includes two protrusions 15*a*, 15*b* that protrude in opposite directions, which are generally parallel to the circumferential direction of the dielectric body 7 (FIGS. 8 and 9). The low projecting portions 12 and the protrusions 15*a*, 15*b* of the low projecting portions 12 are formed together with the high projecting portions 11 in each ridge 9 when corresponding axially spaced portions of the ridge 9, which has a generally constant height along its length, are pressed. In the present embodiment, each ridge 9 before formation of the high projecting portions 11 and the low projecting portions 12 and after formation of the high projecting portions 11 and the low projecting portions 12 will be collectively referred to as the ridge 9.

Figure 4:
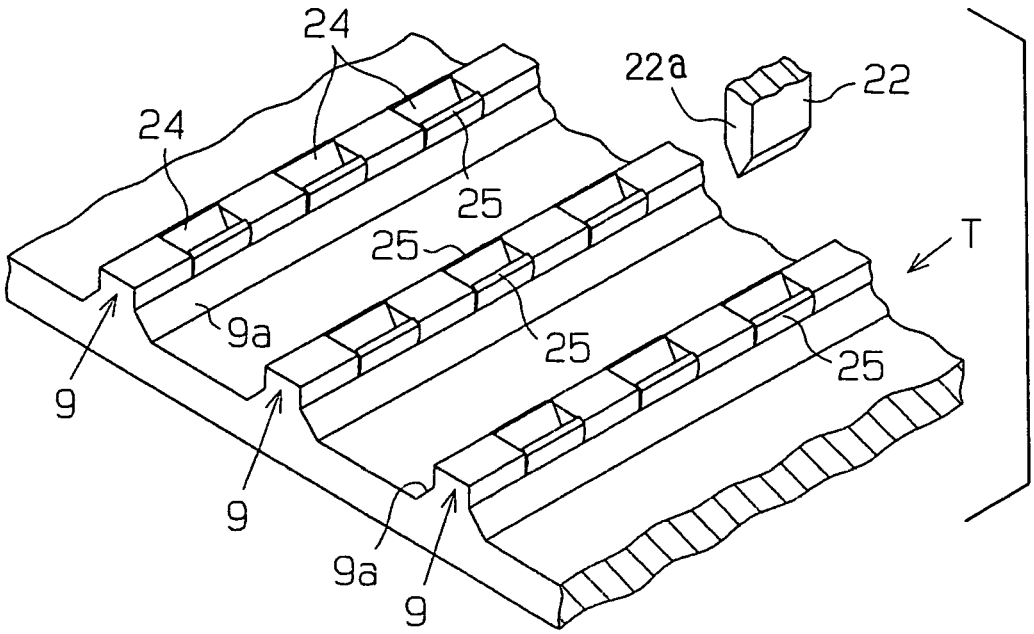
FIG. 4 is a partial perspective view of the commutator plate material, showing a part of a process for forming the low projecting portions and the high projecting portions through use of a first projecting portion forming punch according to the first embodiment.
Figure 5:
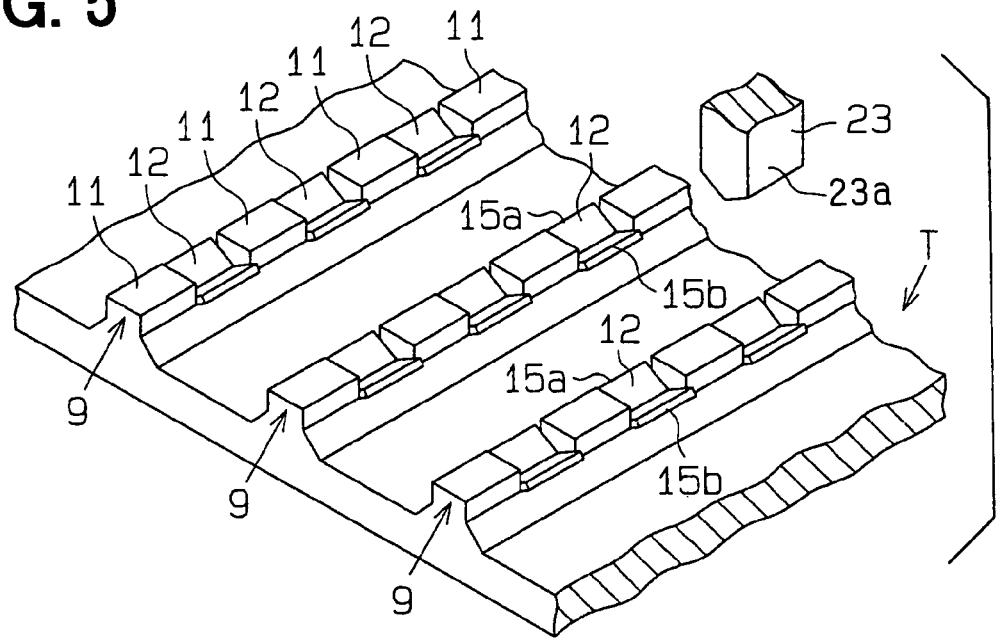
FIG. 5 is a partial perspective view of the commutator plate material, showing another part of the process for forming the low projecting portions and the high projecting portions through use of a second projecting portion forming punch according to the first embodiment.

Each low projecting portion 12 and its protrusions 15*a*, 15*b* are formed when the transverse center of the ridge 9 (corresponding to the center of the ridge 9 in the circumferential direction of the dielectric body 7) is recessed and is deformed outwardly in the transverse direction of the ridge 9 (FIGS. 4 and 5). Thus, the protrusions 15*a*, 15*b* (FIG. 8) of each low projecting portion 12 protrude in the opposite directions, which are generally parallel to the circumferential direction of the dielectric body 7. Furthermore, a bottom of the recessed low projecting portion 12, which has a deepest depth in the low projecting portion 12, is elongated in the longitudinal direction of the ridge 9. In FIG. 8, dotted lines, which correspond to the protrusions 15*a*, 15*b*, indicate base end lines of the protrusions 15*a*, 15*b*. That is, the portions, which project from the dotted lines, correspond to the protrusions 15*a*, 15*b*, respectively.

Each ridge 9 is placed in the dielectric body 7, and the protrusions 14*a*–14*e* and the protrusions 15*a*, 15*b* of the ridge 9 are securely engaged with the dielectric body 7, so that detachment of each commutator segment 8 from the dielectric body 7 is effectively restrained.

Next, a manufacturing method and a manufacturing apparatus (also referred to as a commutator manufacturing apparatus) of the commutator 3 will be described with reference to FIGS. 3 to 9, and the commutator plate material (or simply referred to as the plate material) T, from which the commutator segments 8 of the commutator 3 is made, will also be described.

Figure 3:
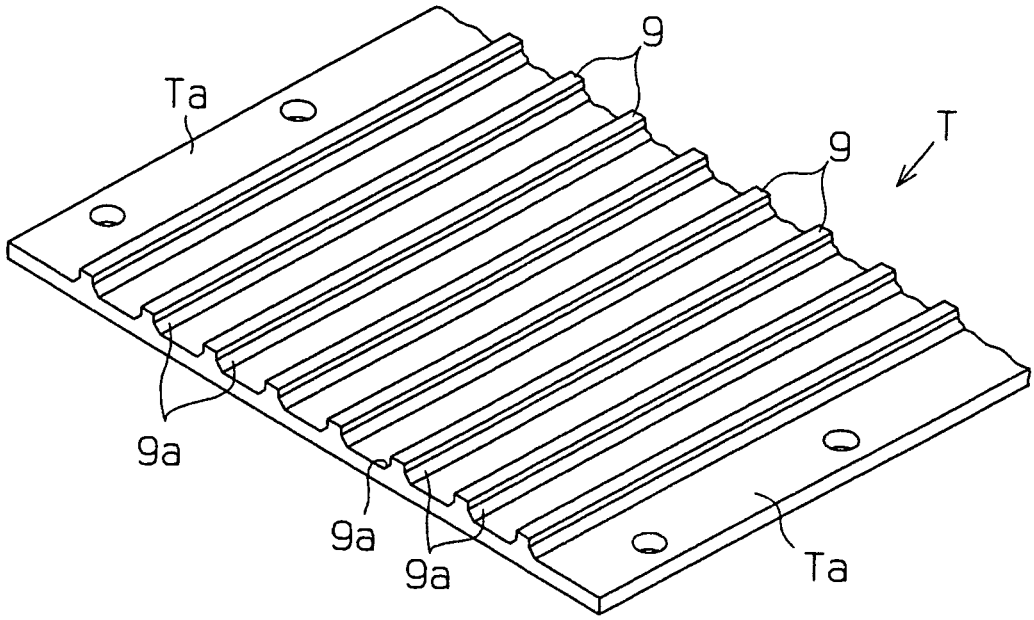
FIG. 3 is a perspective view of a commutator plate material of the first embodiment before formation of low projecting portions and high projecting portions in ridges.

First, as shown in FIG. 3, the electrically conductive plate material T is provided. The plate material T includes a plurality of ridges 9 (in the present embodiment, the number of the ridges 9 is eight), which are parallel to one another and have a predetermined constant height, i.e., a predetermined projecting length. Each ridge 9 includes the widening portion 9*a*, which extends from the intermediate point of the ridge 9 to the base end of the ridge 9 in the projecting direction of the ridge 9 in such a manner that the widening portion 9*a* has the increasing width, which is measured in the transverse direction of the ridge 9 (i.e., the direction perpendicular to the longitudinal direction of the ridge 9) and increases toward the base end of the ridge 9. A length of the plate material T, which is measured in the longitudinal direction of the ridge 9, is equal to or greater than a length (measured in the longitudinal direction of the ridge 9) of each commutator segment 8 that has the unbent commutator riser 8*b*, which has not been bent to form the commutator 3. A width of the plate material T, which is measured in the transverse direction of the ridge 9, is a sum of a circumferential length of the commutator 3 and lengths of frame portions Ta, which are provided at the transverse ends, respectively, of the plate material T. A space between the ridges 9 is set as a predetermined space, which corresponds to the arrangement of the commutator segments 8.

Next, as shown in FIGS. 4 and 5, in a projecting portion forming process for forming the high projecting portions and the low projecting portions, the ridges 9 (FIG. 3), which are parallel to each other and have the predetermined height, are intermittently pressed by first and second projecting portion forming punches 22, 23, each of which has a plurality of press projections 22*a*, 23*a*, to form the high projecting portions 11 and the low projecting portions 12, which are alternately arranged in the longitudinal direction of the corresponding ridge 9. In the present embodiment, for the sake of convenience, the high projecting portions 11 refer to both the high projecting portions 11 before formation of the grooves 13*a*, 13*b* and the high projecting portions 11 after formation of the grooves 13*a*, 13*b*.

The projecting portion forming process includes first and second steps. In the first step, as shown in FIG. 4, the ridges 9, which are parallel to one another and have the predetermined height, are intermittently pressed along its length by the projections 22*a* of the first projecting portion forming punch 22, each of which has a V-shaped distal end oriented in a manner shown in FIG. 4. At this time, the transverse center of each ridge 9, which is the center of the ridge 9 in the circumferential direction of the dielectric body 7, is intermittently pressed by the V-shaped distal ends of the projections 22*a* of the first projecting portion forming punch 22. In the present embodiment, a point angle of the V-shaped distal end of each projection 22*a* of the first projecting portion forming punch 22 is about 60 degrees. Thus, in the first step, as shown in FIG. 4, a plurality of V-shaped grooves 24, each of which is angled about 60 degrees, is formed intermittently along the length of the ridge 9. In each groove 24, two intermediate protrusions 25 protrude from the lateral sides, respectively, of the groove 24 in the transverse direction of the ridge 9.

In the second step, as shown in FIG. 5, each V-shaped groove 24 (FIG. 4) of the ridge 9 is further pressed by the corresponding projection 23*a* of the second projecting portion forming punch 23 to further enlarge or open the V-shaped groove 24. In the present embodiment, a point angle of a V-shaped distal end of each projection 23*a* of the second projecting portion forming punch 23 is about 120 degrees. Thus, in the second step, as shown in FIG. 5, the low projecting portions 12 are formed in each ridge 9. Here, portions of the ridges 9, which are separated by the low projecting portions 12, form the high projecting portions 11. Furthermore, in the second step, the protrusions 15*a*, 15*b*, which protrude in the transverse direction of the ridge 9, are formed in each low projecting portion 12. In FIGS. 4 and 5, only one of the projections 22*a*, 23*a* of the first or second projecting portion forming punch 22, 23, which corresponds to only one low projecting portion 12, is shown, and the entire structure of each of the first and second projecting portion forming punches 22, 23, each of which is integrally formed to punch all of the low projecting portions 12 at once, is not illustrated for the sake of simplicity. Furthermore, in the present embodiment, the first and second projecting portion forming punches 22, 23 serve as projecting portion forming punches and constitute a part of the commutator manufacturing apparatus.

Figure 6:
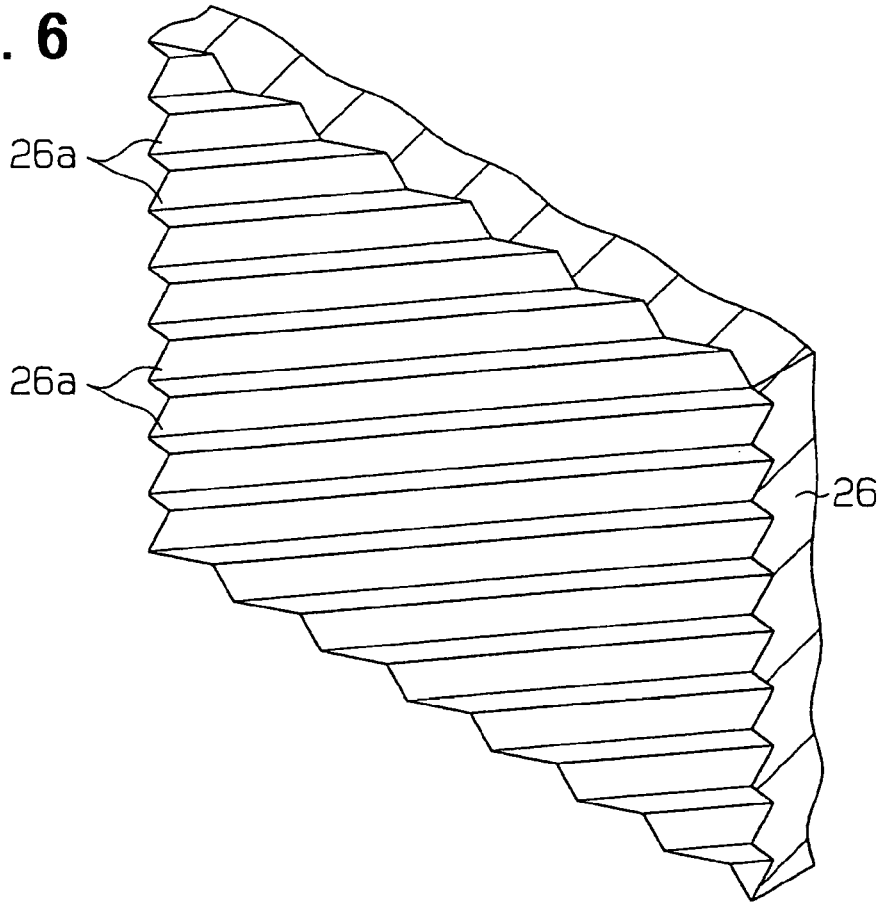
FIG. 6 is a partial schematic view of a groove forming punch according to the first embodiment.
Figure 7A:
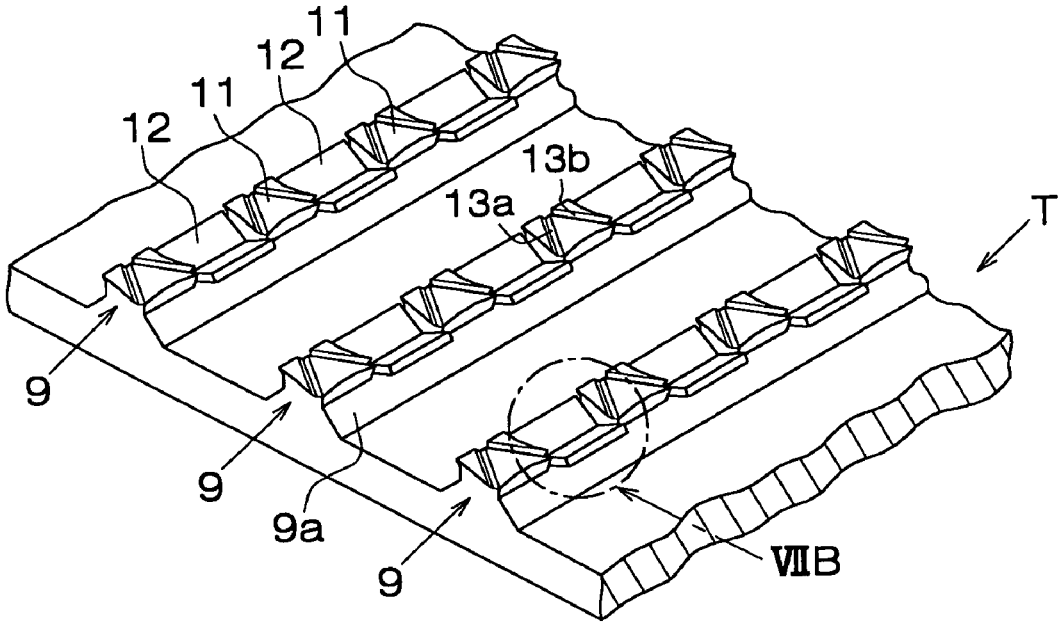
FIG. 7A is a partial perspective view of the commutator plate material, showing grooves formed in the high projecting portions according to the first embodiment.
Figure 7B:
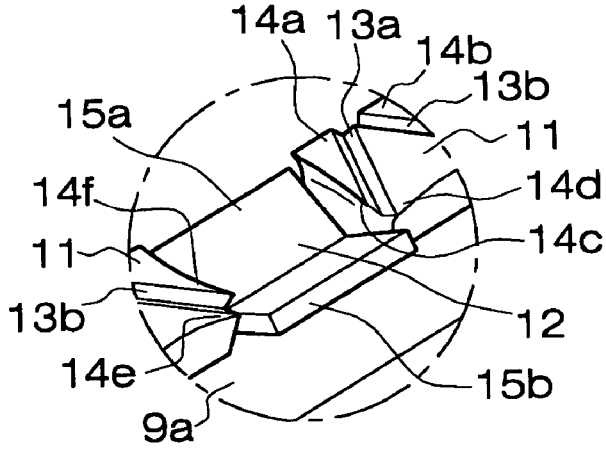
FIG. 7B is an enlarged partial view of a portion encircled by a dot-dot dash line VIIB in FIG. 7A.

Next, as shown in FIG. 6, in a protrusion forming process for forming the protrusions 14*a*–14*f*, the high projecting portions 11 are pressed by a corresponding groove forming punch 26 to form the grooves 13*a* and the corresponding protrusions 14*a*, 14*c*, 14*d*. More specifically, the groove forming punch 26 includes a plurality of press projections 26*a*. Each press projection 26*a* is angled relative to the lateral edge of the ridge 9 and has a reducing width, which is reduced toward a distal end of the press projection 26*a*. When the high projecting portions 11 are pressed by the groove forming punch 26, the grooves 13*a* and the protrusions 14*a*, 14*c*, 14*d* are formed simultaneously to project in the corresponding direction perpendicular to the projecting direction of the high projecting portion 11. That is, the acutely angled portions of each high projecting portion 11, which are separated by the groove 13*a*, are displaced outwardly and are projected to form the protrusions 14*a*, 14*c*, 14*d*. Furthermore, in the present embodiment, the grooves 13*b* and the protrusions 14*b*, 14*f*, 14*e* are formed by another groove forming punch (not shown), which has a plurality of press projections angled in an opposite direction opposite to that of the press projections 26*a* of the groove forming punch 26. Furthermore, for the sake of convenience, in the present embodiment, the plate material T refers both the plate material T before formation of the grooves 13*a*, 13*b* and the protrusions 14*a*–14*f* and the plate material T after formation of the grooves 13*a*, 13*b* and the protrusions 14*a*–14*f*. The groove forming punch 26 and the groove forming punch (not shown), which has the press projections angled in the direction opposite to that of the press projections 26*a* of the groove forming punch 26, constitute a part of the commutator manufacturing apparatus.

Thereafter, as shown in FIG. 9, the frame portions Ta (FIG. 3) and other unneeded portions of the plate material T are cut by punching to form the plate material T into a predetermined size and also to form the unbent commutator risers 8*b*. Here, the predetermined size of the plate material T should correspond to the axial length and the circumferential length of the commutator 3. Also, in the present embodiment, the plate material (FIG. 9) corresponds to the commutator plate material of the present invention.

Next, in a rolling process, the plate material T is rolled into the cylindrical shape such that the ridges 9 are placed on the inner peripheral side of the cylindrically rolled plate material T.

Thereafter, in a resin filling process, the cylindrically rolled plate material T is placed in a molding die (not shown), and liquid resin (molten resin), which serves as a dielectric material, is filled into a space located radially inward of the cylindrically rolled plate material T held in the molding die.

Then, after solidification of the resin, the commutator risers 8*b* are bent radially outward (FIG. 2).

Then, as shown in FIG. 2, in a commutator finishing process, the cylindrically rolled plate material T is cut and divided into eight sections at equal angular intervals to form the commutator segments 8. More specifically, the cylindrically rolled plate material T, which has the solidified resin placed radially inward of the plate material T, is radially cut from an outer peripheral surface of the plate material T all the way to the solidified resin along the dot-dot dash lines of FIG. 9 in a cutting process to form dividing grooves 27, which extend from one axial end of the cylindrically rolled plate material T to the other axial end of the cylindrically rolled plate material T. As a result, the commutator segments 8 and the dielectric body 7 are formed. In this way, the manufacturing of the commutator 3 is completed.

Next, advantages of the commutator 3 and the commutator plate material (plate material) T formed by the above manufacturing method and the manufacturing apparatus will be described.

(1) The ridge 9 of each commutator segment 8, which is held in the dielectric body 7, includes the high projecting portions 11 and the low projecting portions 12, which are formed by the first and second projecting portion forming punches 22, 23 and are alternately arranged in the axial direction of the dielectric body 7. In each high projecting portion 11, the grooves 13*a*, 13*b* are formed by the groove forming punch 26 and the other groove forming punch (not shown) such that the grooves 13*a*, 13*b* are angled relative to the axial direction of the dielectric body 7. At the time of forming the grooves 13*a*, 13*b*, the protrusions 14*a*–14*f*, each of which protrudes in the corresponding direction perpendicular to the projecting direction of the high projecting portion 11, are simultaneously formed. The acutely angled portions of each high projecting portion 11, which are separated by the grooves 13*a*, 13*b*, have relatively small volumes and thus can be easily deformed. Thus, only a relatively small force or pressure needs to be applied to the corresponding groove forming punch to form the protrusions 14*a*–14*f*. The protrusions 14*a*–14*f* are placed in the dielectric body 7 along with the ridges 9 to securely engage with the dielectric body 7 and thus to prevent detachment of the commutator segments 8 from the dielectric body 7. Furthermore, for example, at the time of fusing the coil 4*a* to the corresponding commutator riser 8*b* through the resistant welding, a relatively large force is applied to the riser 8*b* side axial end of the commutator segment 8 by the fusing electrode 10. However, the other axial end of the commutator segment 8 is less likely lifted away from the dielectric body 7 in comparison to the prior art commutator, in which each ridge has the constant height or the constant projecting length along the axial direction, since each high projecting portion 11 axially engages with the dielectric body 7 to limit lifting of the commutator segment 8. As a result, it is possible to reduce formation of a step from one commutator segment 8 to the next commutator segment 8, and thus generation of vibrations, mechanical noises and electrical noises can be restrained or reduced.

(2) In each low projecting portion 12, the protrusions 15*a*, 15*b*, which protrude in the direction perpendicular to the projecting direction of the low projecting portion 12 and parallel to the circumferential direction of the dielectric body 7, are formed. Thus, detachment of the commutator segments 8 from the dielectric body 7 is further restrained.

(3) When each ridge 9 is intermittently pressed along the length of the ridge 9 by the first and second projecting portion forming punches 22, 23, the low projecting portions 12 and the protrusions 15*a*, 15*b* of the low projection portions 12 are formed together with the high projecting portions 11. Thus, in comparison to a case where the protrusions 15*a*, 15*b* are formed separately from the low projecting portions 12 in separate steps, the number of manufacturing steps can be reduced.

(4) The low projecting portions 12 and the protrusions 15*a*, 15*b* of the low projecting portions 12 are formed in each ridge 9 when the transverse center of the ridge 9 is pressed by the first and second projecting portion forming punches 22, 23. In this way, the protrusions 15*a*, 15*b* can be effectively protruded in the circumferential direction of the dielectric body 7. As a result, detachment of the commutator segments 8 from the dielectric body 7 is further restrained.

(5) The protrusions 14*c*, 14*f* are formed to protrude in the corresponding direction, which is perpendicular to the projecting direction of the corresponding high projecting portion 11 and is parallel to the axial direction of the dielectric body 7. Thus, at the time of fusing the coil 4*a* to the corresponding commutator riser 8*b* of the commutator segment 8, the lifting of the other axial end of the commutator segment 8, which is apart from the commutator riser 8*b*, is further restrained. Furthermore, the protrusions 14*c*, 14*f*, which protrude in the direction parallel to the axial direction of the dielectric body 7, are formed by the groove forming punch 26 and the other groove forming punch (not shown) together with the protrusions 14*a*, 14*b*, 14*d*, 14*e*, which protrude in the circumferential direction of the dielectric body 7. Thus, at the time of forming the protrusions 14*a*, 14*b*, 14*d*, 14*e*, the protrusions 14*c*, 14*f* can be easily formed by the groove forming punch 26 and the other groove forming punch (not shown) without requiring any other dedicated manufacturing step.

(Second Embodiment)

In the first embodiment, the low projecting portions 12 and the protrusions 15*a*, 15*b* of the low projecting portions 12 are formed by pressing the transverse center of the corresponding ridge 9 with the first and second projecting portion forming punches 22, 23. However, the low projecting portions 12 and the protrusions 15*a*, 15*b* of the low projecting portions 12 can be formed by any other method and any other devices (i.e., the punches).

Figure 10:
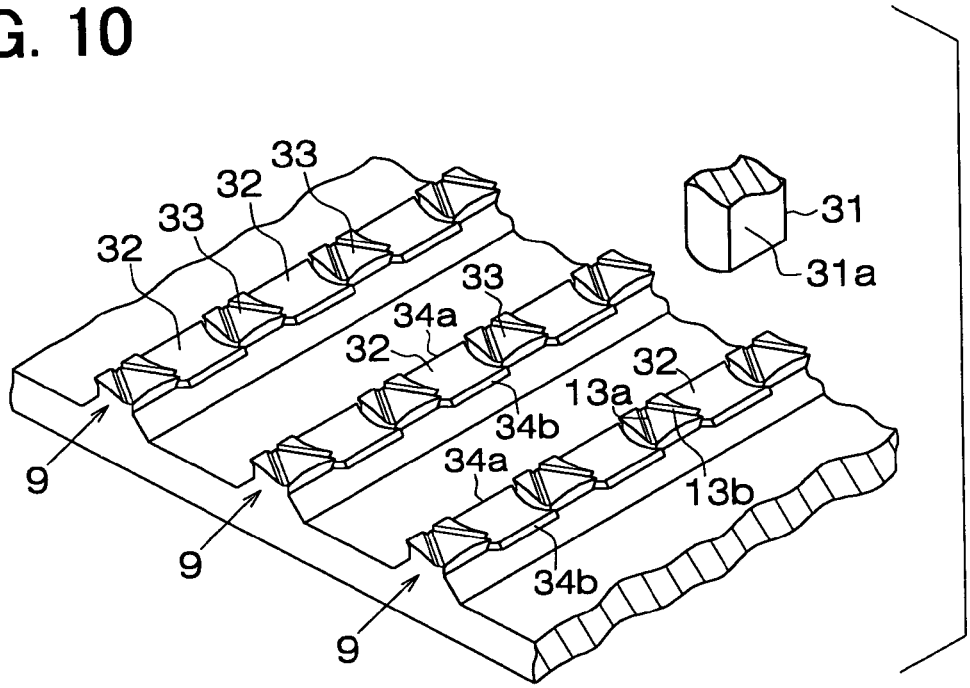
FIG. 10 is a partial perspective view of a commutator plate material according to a second embodiment of the present invention, showing the commutator plate material and a projecting portion forming punch.

In the second embodiment, as shown in FIG. 10, each ridge 9 (FIG. 3) is intermittently punched along the length of the ridge 9 by a plurality of press projections 31*a* of a projecting portion forming punch 31, each of which has a curved distal end, to alternately form low projecting portions 32 and high projecting portions 33 along the length of each ridge 9. At this time, a cylindrically curved concave surface is formed by the projection 31*a* of the projecting portion forming punch 31 in a surface of each low projecting portion 32. The transverse center of the cylindrically curved concave surface of the low projecting portion 32 has the lowest height or the lowest projecting length in the projecting direction (i.e., in a thickness direction of the plate material, which is perpendicular to the plane of the plate material) of the ridge 9. Protrusions 34*a*, 34*b* are formed to protrude in the circumferential direction of the dielectric body 7, as shown in FIG. 10. FIG. 10 shows the plate material, in which the grooves 13*a*, 13*b* are formed after the pressing process for forming the low projecting portions 32 and the high projecting portions 33. Even in the second embodiment, the protrusions 34*a*, 34*b* of each low projecting portion 32 can be effectively protruded in the circumferential direction of the dielectric body 7. Thus, detachment of the commutator segments from the dielectric body can be further restrained.

Furthermore, at the time of forming the low projecting portions 32 of FIG. 10, it is possible to punch each ridge 9 by the first projecting portion forming punch 22 of FIG. 4 and then to punch the thus formed recesses by the projecting portion forming punch 31 to form the low projecting portions 32 having the cylindrically curved concave surface. That is, the low projecting portions 32 can be formed in two steps using the first projecting portion forming punch 22 and the projecting portion forming punch 31.

(Third Embodiment)

In the above embodiments, the single ridge 9 is formed in the center of each commutator segment 8. Alternatively, two or more ridges 9, which are parallel to each other, can be formed in each commutator segment 8.

Figure 11:
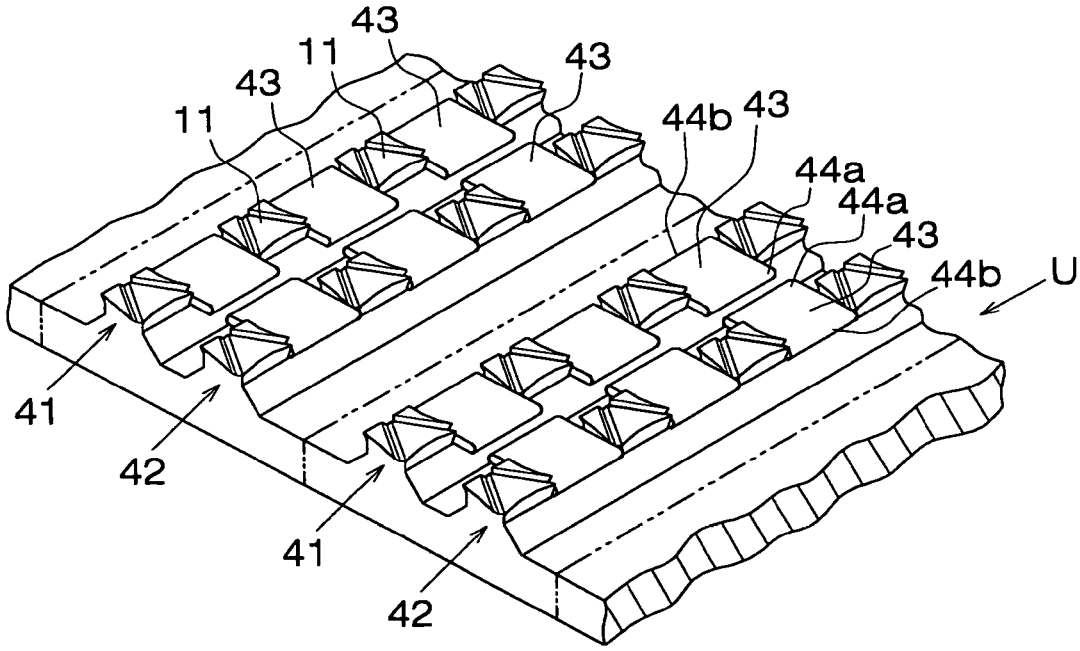
FIG. 11 is a partial perspective view of a commutator plate material according to a third embodiment of the present invention.
Figure 12A:
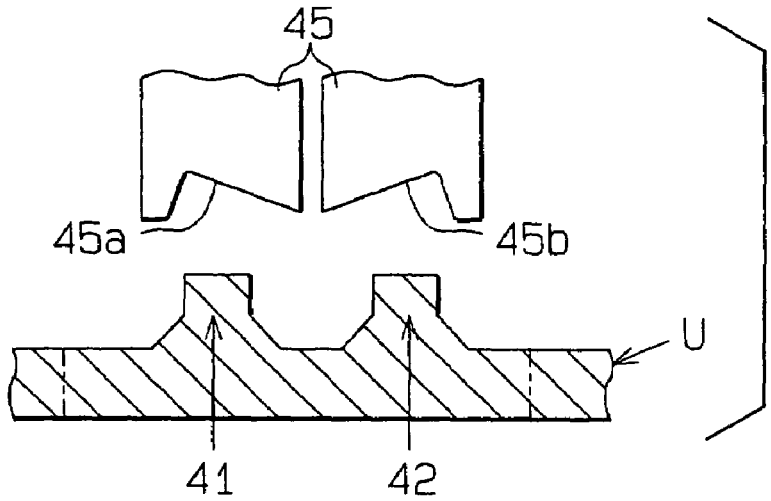
FIG. 12A is a schematic partial cross sectional view of the commutator plate material of the third embodiment, showing paired ridges and a first projecting portion forming punch.
Figure 12B:
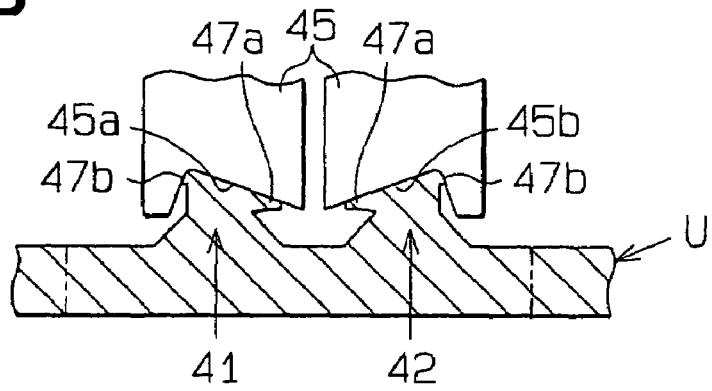
FIG. 12B is a schematic partial cross sectional view of the commutator plate material of the third embodiment, showing processing of the paired ridges through use of the first projecting portion forming punch.
Figure 12C:
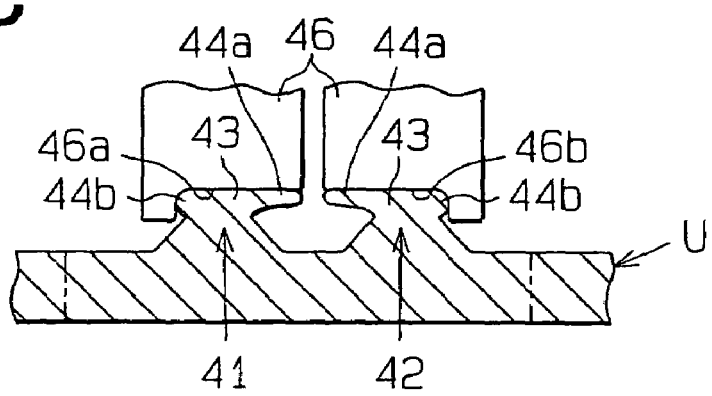
FIG. 12C is a schematic partial cross sectional view of the commutator plate material of the third embodiment, showing further processing of the paired ridges through use of a second projecting portion forming punch.

In the third embodiment, as shown in FIG. 11, in place of the plate material T, a plate material U is provided. A ridge (first ridge) 41 and a ridge (second ridge) 42 are paired, and eight pairs of ridges 41, 42 are provided in the plate material U (only two pairs are shown in FIG. 11). In each ridge 41, 42, a plurality of low projecting portions 43 and a plurality of high projecting portions 11 are alternately arranged in the longitudinal direction of the ridge 41, 42. Each low projecting portion 43 includes first and second protrusions 44*a*, 44*b*. Each of the protrusions 44*a*, 44*b* of the low projecting portion 43 protrudes in the corresponding direction, which is perpendicular to the projecting direction of the low projecting portion 43 and is parallel to the circumferential direction of the dielectric body 7 (FIG. 12C). As shown in FIGS. 12A–12C, the low projecting portions 43 and the protrusions 44*a*, 44*b* of the low projecting portions 43 are simultaneously formed by first and second projecting portion forming punches 45, 46. More specifically, the paired ridges 41, 42 (FIG. 12A) of a generally constant height are intermittently pressed by the first and second projecting portion forming punches 45, 46 along the length of the ridge 41, 42. In this instance, for the sake of convenience, the ridges 41, 42 refer to the ridges 41, 42 (FIG. 12A) before formation of the high projecting portions 11 and the low projecting portions 43 and also the ridges 41, 42 after formation of the high projecting portions 11 and the low projecting portions 43. The high projecting portions 11, each of which includes the grooves 13*a*, 13*b* and the protrusions 14*a*–14*f*, are formed in a manner similar to the one discussed with reference to the first embodiment and thus will not be described further.

The first projecting portion forming punch 45 has paired press grooves 45*a*, 45*b*, which correspond to and press the paired ridges 41, 42, respectively. Similarly, the second projecting portion forming punch 46 has paired press grooves 46*a*, 46*b*, which correspond to and press the paired ridges 41, 42, respectively. As shown in FIG. 12B, the first projecting portion forming punch 45 is designed such that the paired press grooves 45*a*, 45*b* form a first intermediate protrusion 47*a* and a second intermediate protrusion 47*b* in the corresponding ridges 41, 42 at the time of pressing. The first intermediate protrusion 47*a* is longer than the second intermediate protrusion 47*b*. The first intermediate protrusions 47*a* of the paired ridges 41, 42 protrude toward each other, and the second intermediate protrusions 47*b* of the paired ridges 41, 42 protrude away from each other. Furthermore, as shown in FIG. 12C, the second projecting portion forming punch 46 is designed such that the paired press grooves 46*a*, 46*b* press the first intermediate protrusions 47*a* and the second intermediate protrusions 47*b* to form the first protrusions 44*a* and second protrusions 44*b*. A protruding length of the first protrusion 44*a*, which is measured in the circumferential direction of the dielectric body 7, is longer than that of the second protrusion 44*b*. Furthermore, each of the first protrusions 44*a* of one of the paired ridges 41, 42 and a corresponding one of the first protrusions 44*a* of the other one of the paired ridges 41, 42 protrude toward each other. Also, each of the second protrusions 44*b* of the one of the paired ridges 41, 42 and a corresponding one of the second protrusions 44*b* of the other one of the paired ridges 41, 42 protrude away from each other. The press grooves 45*a*, 45*b* of the first projecting portion forming punch 45 and the press grooves 46*a*, 46*b* of the second projecting portion forming punch 46 are designed to form the low projecting portions 43 and the protrusions 44*a*, 44*b* of the low projecting portions 43 in the two steps. In FIGS. 11, 12A–12C, dot-dot dash lines indicate positions, at which the plate material U is cut and is divided to form the commutator segments 8.

As discussed above, the plate material U, in which the low projecting portions 43 and the protrusions 44*a*, 44*b* are formed by the first projecting portion forming punch 45 and the second projecting portion forming punch 46, includes the paired ridges 41, 42. Each pair of ridges 41, 42 is provided in each commutator segment 8. Furthermore, the first protrusions 44*a*, which protrude toward each other, protrude longer than the second protrusions 44*b*, which protrude away from each other. Thus, when the ridges 41, 42 are held in the dielectric body 7, engagement between the opposed second protrusions 44*b* of the adjacent commutator segments 8 is effectively prevented. In this way, the contact (i.e., short-circuit) between the commutator segments 8 is prevented.

(Fourth Embodiment)

In the first embodiment, the V-shaped groove of each low projecting portion 12 extends in the longitudinal direction of the ridge 9, as shown in FIG. 9. Contrary to this, in the fourth embodiment, with reference to FIG. 13A, a V-shaped groove of each low projecting portion 12*a* extends in the transverse direction of the ridge 9. That is, a bottom of the recessed low projecting portion 12*a*, which has a deepest depth in the low projecting portion 12*a*, is elongated in the circumferential direction of the dielectric body 7. Since the structure of the plate material T other than the low projecting portions 12*a* is substantially the same as that of the first embodiment, only the low projecting portions 12*a* will be described.

Figure 13A:
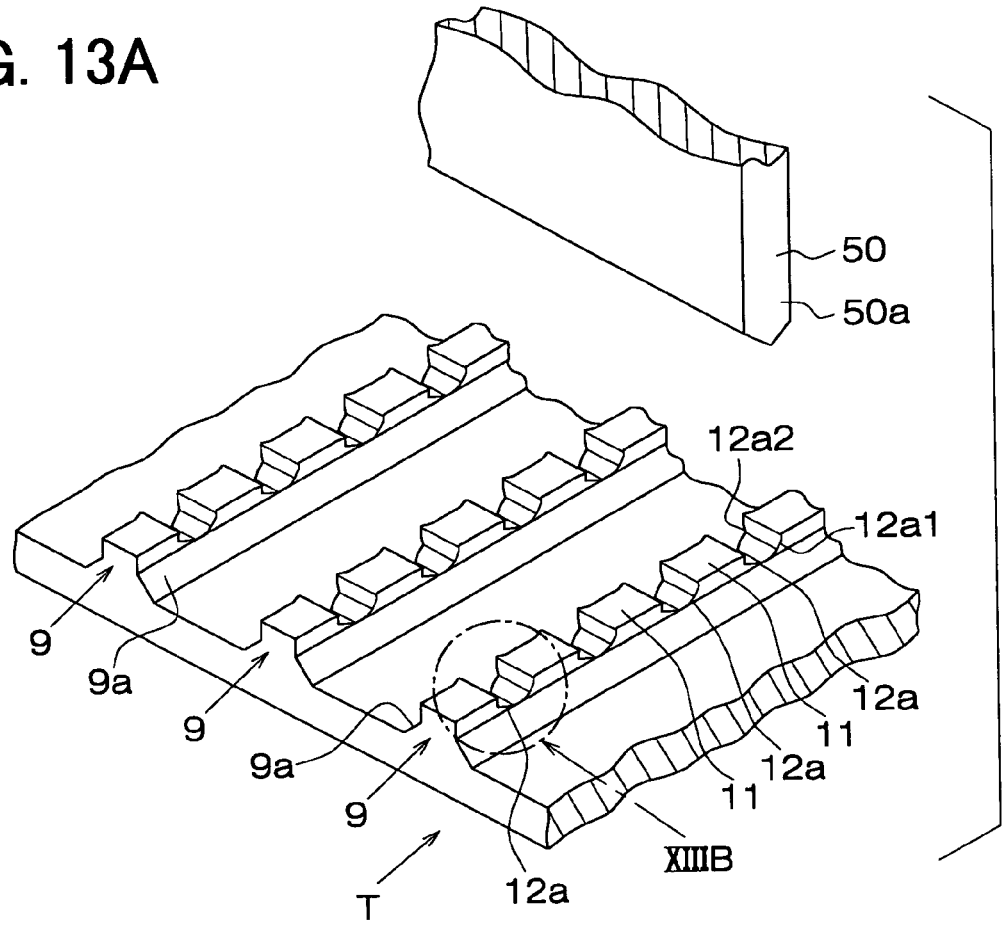
FIG. 13A is a schematic partial perspective view of a commutator plate material according to a fourth embodiment of the present invention, showing a part of a process for forming low projecting portions and high projecting portions through use of a projecting portion forming punch.

With reference to FIG. 13A, the low projecting portions 12*a* are formed in a single step by a projecting portion forming punch 50. The projecting portion forming punch 50 includes a plurality of press projections 50*a* (only one of the press projections 50*a* is shown). The number of the press projections 50*a* is equal to the number of rows of the low projecting portions 12*a* arranged at generally equal intervals in the longitudinal direction of the ridge 9 in the plate material T. A length of the projecting portion forming punch 50, which is measured in the transverse direction of the ridge 9, is equal to or greater than a distance between the frame portions Ta (FIG. 3) of the plate material T. With this arrangement, each press projection 50*a* can press all the low projecting portions 12*a* located in a corresponding single row of the low projecting portions 12*a* at once.

Figure 13B:
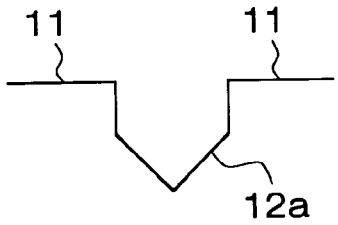
FIG. 13B is an enlarged partial schematic side view seen in a direction of XIIIB in FIG. 13A, showing one of the low projecting portions together with adjacent ones of the high projecting portions.

At the time of performing the pressing process, when the press projection 50*a* of the projecting portion forming punch 50 is pressed against the ridges 9, each low projecting portion 12*a* is pressed to form a V-shaped groove shown in FIG. 13B, and portions of each low projecting portion 12*a*, which are pressed by the press projection 50*a*, protrude outwardly from the V-shaped groove in the transverse direction of the ridge 9 to form protrusions 12*a*1, 12*a*2. The protrusions 12*a*1, 12*a*2 are left in each commutator segment 8, so that protrusions 12*a*1, 12*a*2 are held in and are securely engaged with the dielectric body 7 to further restrain detachment of the commutator segment 8 from the dielectric body 7. Portions of the ridges 9, which are separated by the low projecting portions 12, form the high projecting portions 11.

Figure 13C:
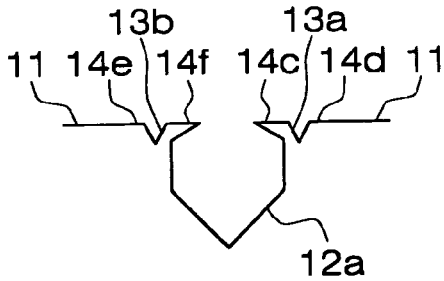
FIG. 13C is an enlarged partial schematic side view similar to FIG. 13B, showing grooves and protrusions formed in the high projecting portions.
Figure 14A:
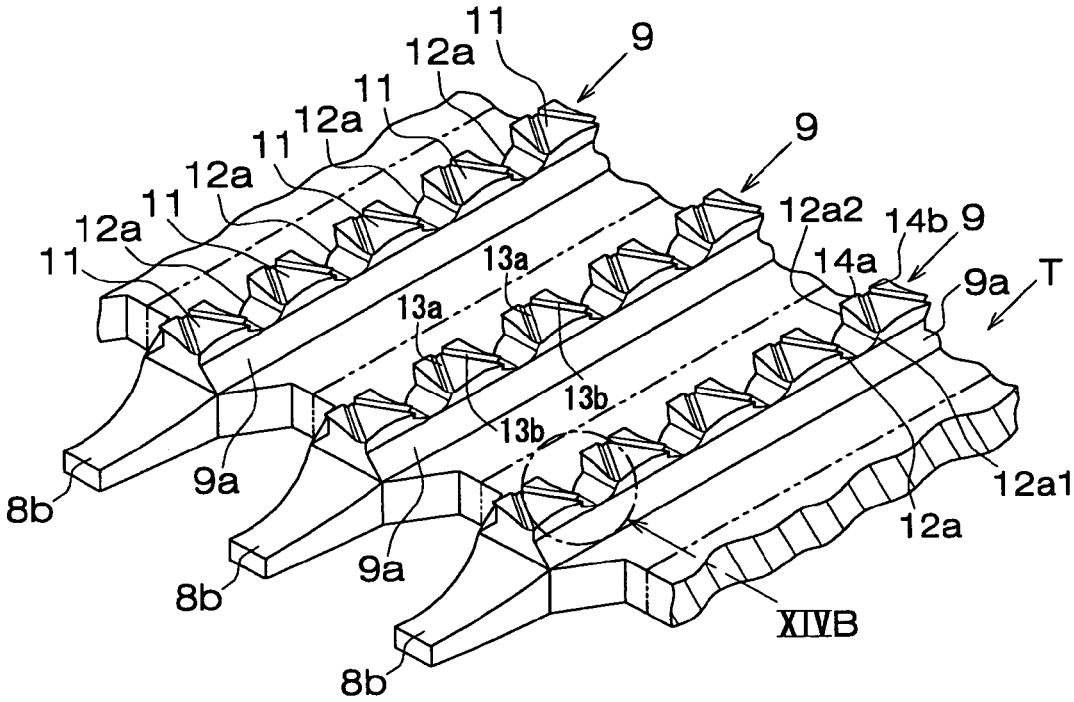
FIG. 14A is a partial schematic perspective view of the commutator plate material of the fourth embodiment, showing the commutator plate material after removal of unneeded portions from the commutator plate material.
Figure 14B:
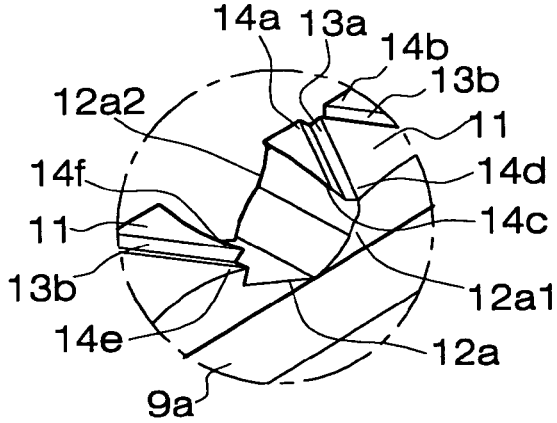
FIG. 14B is an enlarged partial view of a portion encircled by a dot-dot dash line XIVB in FIG. 14A.

After formation of the low projecting portions 12*a*, grooves 13*a*, 13*b* are formed in a manner similar to that of the first embodiment to form the protrusions 14*a*–14*f*, as shown in FIG. 13C. Thereafter, the frame portions Ta (FIG. 3) and other unneeded portions of the plate material T are cut by punching to form the plate material T into a predetermined size and also to form the unbent commutator risers 8*b*, as shown in FIGS. 14A, 14B.

As described above, in the present embodiment, each press projection 50*a* extends in the transverse direction of the ridge 9 to press all the low projecting portions 12*a* present in the single row in the single step. With this arrangement, the number of the press projections 50*a* of the punch 50 is reduced in comparison to the punch 22 or 23 of the first embodiment. Thus, the structure of the punch 50 is simplified.

Furthermore, the ridges 9 can be pressed with smaller force to form the low projecting portions 12*a* when the ridges 9 are pressed in the transverse direction of the ridge 9, as in the fourth embodiment. Thus, load required to be applied to the punch 50 at the time of pressing process can be advantageously reduced in comparison to that of the first embodiment, which is applied to the punch 22 or 23.

When the V-shaped groove is formed in the low projecting portion to extend in the longitudinal direction of the ridge 9 like in the first embodiment, the material of the ridge 9 tends to expand in the transverse direction of the ridge 9 to substantially protrude in the transverse direction. This could cause undesirable influences on reference points of the plate material T used in the manufacturing process (such as sprocket holes used for feeding the plate material T or a side surface of the plate material T) in some cases. However, when the V-shaped groove is formed in the low projecting portion to extend in the transverse direction of the ridge 9 like in the present embodiment, the material of the ridge 9 tends to expand in the longitudinal direction of the ridge 9 and will less likely cause the undesirable influences on the reference points of the plate material T.

Furthermore, because of the low projecting portions 12*a*, the high projecting portions 11 of each ridge 9 can effectively engage with the dielectric body 7 in the longitudinal direction of the ridge 9 like in the first embodiment. Thus, the lifting of the other axial end of the commutator segment 8, which is apart from the commutator riser 8*b*, by the fusing electrode at the time of resistance welding can be advantageously prevented.

(Fifth Embodiment)

Figure 15A:
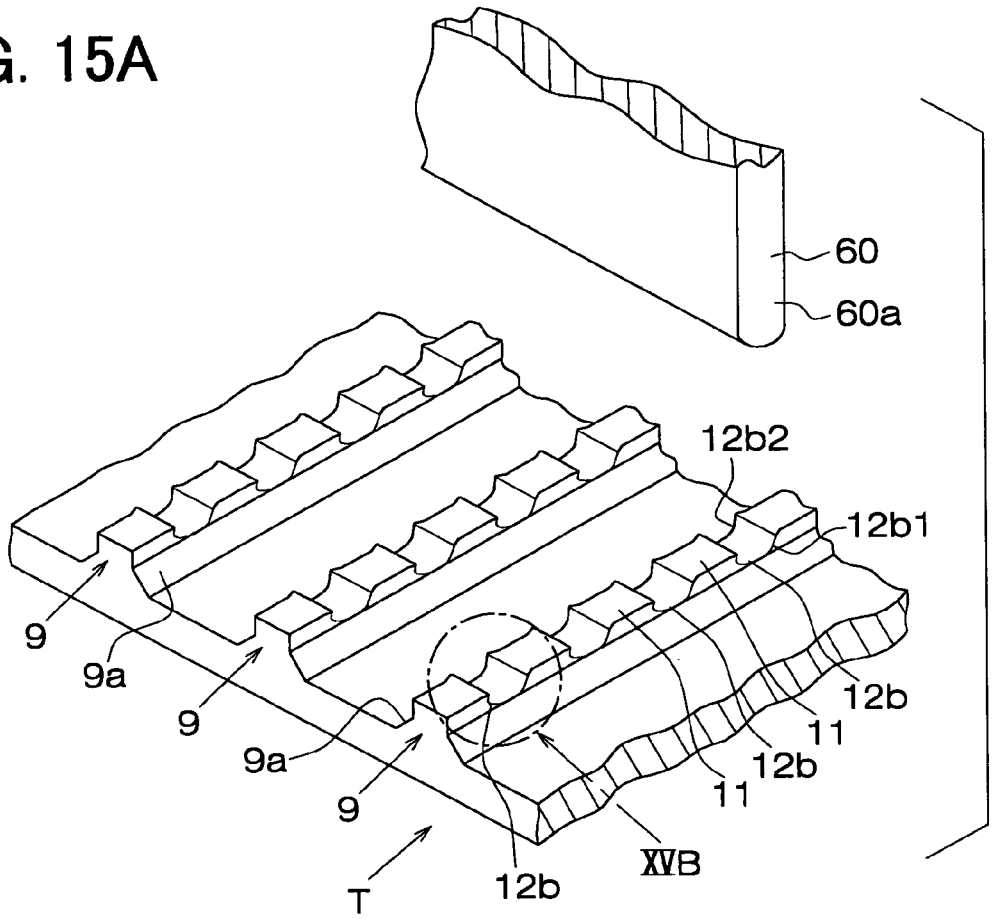
FIG. 15A is a schematic partial perspective view of a commutator plate material according to a fifth embodiment of the present invention, showing a part of a process for forming low projecting portions and high projecting portions through use of a projecting portion forming punch.

In the fourth embodiment, the V-shaped groove is formed in each low projecting portion 12*a* by the punch 50. In the fifth embodiment, the V-shaped groove of the low projecting portion is replaced with a cylindrically curved groove, as shown in FIG. 15A. Since the structure of the plate material T other than the low projecting portions 12*b* is substantially the same as that of the fourth embodiment, only the low projecting portions 12*b* will be described.

In the fifth embodiment, the low projecting portions 12*b* are formed by a projecting portion forming punch 60, which has a plurality of press projections 60*a* (only one of the press projections 60*a* is shown). The projecting portion forming punch 60 differs from the projecting portion forming punch 50 only in the shape of the distal end of each press projection 60*a*. That is, the distal end of each press projection 60*a* has a cylindrically curved convex surface, as shown in FIG. 15A.

Figure 15B:
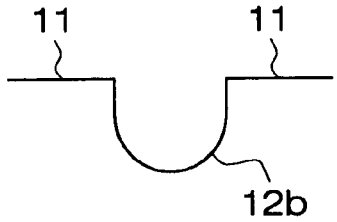
FIG. 15B is an enlarged partial schematic side view seen in a direction of XVB in FIG. 15A, showing one of the low projecting portions together with adjacent ones of the high projecting portions.

At the time of performing the pressing process, when the press projection 60*a* of the projecting portion forming punch 60 is pressed against the ridges 9, each low projecting portion 12*b* is pressed to form a cylindrically curved groove shown in FIG. 15B, and portions of each low projecting portion 12*b*, which are pressed by the press projection 60*a*, protrude outwardly from the cylindrically curved groove in the transverse direction of the ridge 9 to form protrusions 12*b*1, 12*b*2. The protrusions 12*b*1, 12*b*2 are left in each commutator segment 8, so that protrusions 12*b*1, 12*b*2 are held in and are securely engaged with the dielectric body 7 to further restrain detachment of the commutator segment 8 from the dielectric body 7.

Figure 15C:
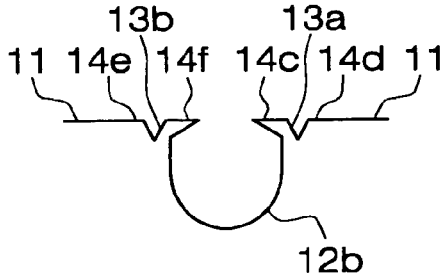
FIG. 15C is an enlarged partial schematic side view similar to FIG. 15B, showing grooves and protrusions formed in the high projecting portions.

After formation of the low projecting portions 12*b*, grooves 13*a*, 13*b* are formed in a manner similar to that of the first embodiment to form the protrusions 14*a*–14*f*, as shown in FIG. 15C.

The fifth embodiment provides advantages similar to those discussed in the fifth embodiment.

(Sixth Embodiment)

In the first embodiment, each ridge 9 of the commutator segments 8 extends from the base end of the commutator riser 8*b* to the other axial end of the commutator segment 8, which is apart from the commutator riser 8*b*, as shown in FIG. 9.

Figure 16:
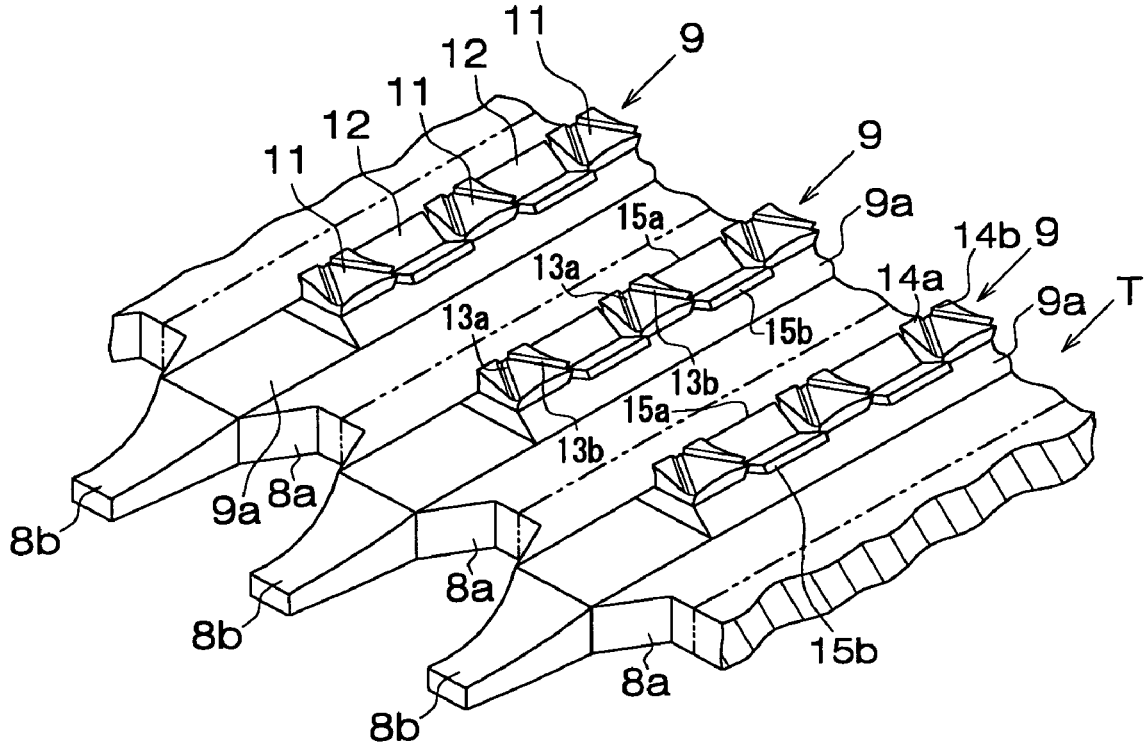
FIG. 16 is a partial perspective view of a commutator plate material after removal of unneeded portions from the commutator plate material according to a sixth embodiment of the present invention.

However, in the sixth embodiment, as shown in FIG. 16, each ridge 9 is axially spaced away from the base end of the commutator riser 8*b* and is also axially spaced away from the base end of the width reducing portion 8*a*.

With reference to FIG. 2, when the fusing electrode 10 is urged against the commutator riser 8*b* to weld the coil 4*a* to the commutator riser 8*b* and the width reducing portion 8*a* during the resistance welding, a relatively large amount of heat is generated and is conducted from the distal end of the commutator riser 8*b* to the width reducing portion 8*a* and then to the dielectric body 7. The heat is also conducted from the base end of the commutator riser 8*b* to the ridge 9 of the commutator segment 8, which is located adjacent the base end of the commutator riser 8*b*, and then to the dielectric body 7. Application of the relatively large amount of heat sometimes causes a significant thermal damage to the resin of the dielectric body 7. When this happens, the securing force of the dielectric body 7 for securely holding the commutator segment 8 can be significantly reduced to facilitate the lifting of the other end of the commutator segment 8, which is apart from the commutator riser 8*b*, away from the dielectric body 7, or a space can be formed between the commutator segment 8 and the dielectric body 7. This may cause, for example, formation of a step from one commutator segment 8 to the next commutator segment 8, causing generation of vibrations, mechanical noises and electrical noises.

However, according to the present embodiment, the ridge 9 of each commutator segment 8 is spaced from both the base end of the commutator riser 8*b* and the base end of the width reducing portion 8*a*. Thus, the thickness of the width reducing portion 8*a* of the commutator segment 8 (i.e., the radial size of the width reducing portion 8*a*) is advantageously reduced. As a result, the heat generated at the time of resistance welding can be concentrated in the commutator riser 8*b* and the width reducing portion 8*a*. This allows a reduction in the amount of heat conducted to the dielectric body 8 at the time of resistance welding to reduce the thermal damage to the dielectric body 8. Therefore, the lifting of the other end of the commutator segment 8, which is apart from the commutator riser 8*b*, can be further restrained.

(Modifications)

In the above embodiments, the protrusions 12*a*1, 12*a*2, 12*b*1, 12*b*2, 15*a*, 15*b*, 34*a*, 34*b*, 44*a*, 44*b* are provided in the low projecting portions 12, 12*a*, 12*b*, 32, 43. However, the protrusions 12*a*1, 12*a*2, 12*b*1, 12*b*2, 15*a*, 15*b*, 34*a*, 34*b*, 44*a*, 44*b* can be eliminated from the low projecting portions 12, 12*a*, 12*b*, 32, 43. Even with this modification, advantage similar to one discussed in the section (1) of the first embodiment can be achieved.

In the above embodiment, the protrusions 12*a*1, 12*a*2, 12*b*1, 12*b*2, 15*a*, 15*b*, 34*a*, 34*b*, 44*a*, 44*b* of the low projecting portions 12, 12*a*, 12*b*, 32, 43 are formed simultaneously at the time of forming the low projecting portions 12, 12*a*, 12*b*, 32, 43. However, the step of forming the low projecting portions and the step of forming the protrusions in the low projecting portions in the direction perpendicular to the projecting direction of the low projecting portions (i.e., the circumferential direction of the dielectric body) can be separately performed. Even with this modification, advantages similar to those discussed in the sections (1) and (2) of the first embodiment can be achieved.

In the above embodiments, the protrusions 14*c*, 14*f* are formed in the high projecting portions 11 to protrude in the direction, which is perpendicular to the projecting direction of the high projecting portion 11 and is parallel to the axial direction of the dielectric body 7. However, the protrusions 14*c*, 14*f* can be eliminated from the high projecting portions 11. Even with this modifications, the advantages similar to those discussed in the above sections (1) to (4) of the first embodiment can be achieved. Furthermore, the step of forming the protrusions 14*c*, 14*f* can be separated from the step of forming the protrusions 14*a*, 14*b*, 14*d*, 14*e*, which protrude in the circumferential direction of the dielectric body 7.

In the above embodiments, the present invention is embodied in the commutator 3, which includes eight commutator segments 8. However, the present invention can be embodied in a commutator, which includes more than or less than eight commutator segments.

Additional advantages and modifications will readily occur to those skilled in the art. The invention in its broader terms is therefore not limited to the specific details, representative apparatus, and illustrative examples shown and described.

What is claimed is:

1. A commutator comprising:

a generally cylindrical dielectric body; and a plurality of commutator segments arranged along an outer peripheral surface of the dielectric body, wherein each commutator segment includes at least one ridge, which extends in a direction generally parallel to an axial direction of the commutator and radially inwardly projects into the dielectric body to secure the commutator segment relative to the dielectric body;

each ridge includes a plurality of high projecting portions and a plurality of low projecting portions, wherein each high projecting portion has a projecting length, which is measured from abase end of the ridge in a projecting direction of the ridge and is longer than that of each low projecting portion;

the high projecting portions and the low projecting portions of each ridge are alternately arranged in a longitudinal direction of the ridge;

at least one of the low projecting portions of each ridge has at least one protrusion, which protrudes in a transverse direction that is perpendicular to the longitudinal direction of the ridge;

each adjacent one of the high projecting portions of each ridge, which is adjacent to a corresponding one of the at least one of the low projecting portions of the ridge, includes:

at least one groove that is obliquely angled relative to the longitudinal direction of the ridge; and at least one protrusion, each of which is bound with a corresponding one of the at least one groove and protrudes in an imaginary plane generally perpendicular to the projecting direction of the ridge over a corresponding adjacent one of the at least one protrusion of the adjacent low projecting portion, so that a first space is defined on one side of the adjacent protrusion of the low projecting portion, and a second space is defined on the other side of the adjacent protrusion of the low projecting portion between the adjacent protrusion of the low projecting portion and the protrusion of the high projecting portion; and at least a portion of the first space and at least a portion of the second space are placed along an imaginary line that is parallel to the projecting direction of the ridge.

2. The commutator according to claim 1, wherein:

the at least one ridge of each commutator segment includes first and second ridges;

each low projecting portion of each of the first and second ridges includes first and second protrusions, which protrude away from each other in a circumferential direction of the dielectric body;

a protruding length of each first protrusion, which is measured in the circumferential direction of the dielectric body, is longer than that of each second protrusion;

each of the first protrusions of the first ridge and a corresponding one of the first protrusions of the second ridge protrude toward each other in the circumferential direction of the dielectric body; and each of the second protrusions of the first ridge and a corresponding one of the second protrusions of the second ridge protrude away from each other in the circumferential direction of the dielectric body.

3. The commutator according to claim 1, wherein each low projecting portion is recessed such that a bottom of the recessed low projecting portion, which has a deepest depth in the low projecting portion, is elongated in the longitudinal direction of the corresponding ridge.

4. The commutator according to claim 3, wherein the recessed low projecting portion is curved.

5. The commutator according to claim 3, wherein the recessed low projecting portion is V-shaped.

6. The commutator according to claim 1, wherein each low projecting portion is recessed such that a bottom of the recessed low projecting portion, which has a deepest depth in the low projecting portion, is elongated in a circumferential direction of the dielectric body.

7. The commutator according to claim 6, wherein the recessed low projecting portion is curved.

8. The commutator according to claim 6, wherein the recessed low projecting portion is V-shaped.

9. The commutator according to claim 1, wherein:

each commutator segment further includes a commutator riser; and each ridge of each commutator segment is spaced a predetermined distance from a base end of the commutator riser.

10. A commutator plate material comprising a plurality of parallel ridges, wherein:

each ridge includes a plurality of high projecting portions and a plurality of low projecting portions, wherein each high projecting portion has a projecting length, which is measured from a base end of the ridge in a projecting direction of the ridge and is longer than that of each low projecting portion;

the high projecting portions and the low projecting portions of each ridge are alternately arranged in a longitudinal direction of the ridge;

at least one of the low projecting portions of each ridge has at least one protrusion, which protrudes in a transverse direction that is perpendicular to the longitudinal direction of the ridge;

each adjacent one of the high projecting portions of each ridge, which is adjacent to a corresponding one of the at least one of the low projecting portions of the ridge, includes:

at least one groove that is obliquely angled relative to the longitudinal direction of the ridge; and at least one protrusion, each of which is bound with a corresponding one of the at least one groove and protrudes in an imaginary plane generally perpendicular to the projecting direction of the ridge over a corresponding adjacent one of the at least one protrusion of the adjacent low projecting portion, so that a first space is defined on one side of the adjacent protrusion of the low projecting portion, and a second space is defined on the other side of the projecting portion and the protrusion of the high projecting portion; and at least a portion of the first space and at least a portion of the second space are placed along an imaginary line that is parallel to the projecting direction of the ridge.

11. The commutator according to claim 1, wherein:

in a cross section taken along an imaginary plane that is perpendicular to the longitudinal direction of the ridge, the at least one of to low projecting portions of each ridge has a recess that extends in a direction opposite to the projecting direction of the ridge; and the depth of the recess increases toward a center of the low projecting portion in the transverse direction.

12. The commutator according to claim 11, wherein the recessed cross-section of the at least one of the low projecting portions of each ridge is V-shaped.

13. The commutator according to claim 11, wherein the recessed cross-section of the at least one of the low projecting portions of each ridge is curved.

14. The commutator plate material according to claim 10, wherein:

in a cross section taken along an imaginary plane that is perpendicular to the longitudinal direction of the ridge, the at least one of the low projecting portions of each ridge has a recess that extends in a direction opposite to the projecting direction of the ridge; and the depth of the recess increases toward a center of the low projecting portion in the transverse direction.

15. The commutator plate material according to claim 14, wherein the recessed cross-section of the at least one of the low projecting portions of each ridge is V-shaped.

16. The commutator plate material according to claim 14, the recessed cross-section of the at least one of the low projecting portions of each ridge is curved.

* * * * *